US010728684B1

(12) United States Patent
Wang et al.

(10) Patent No.: US 10,728,684 B1
(45) Date of Patent: Jul. 28, 2020

(54) HEAD RELATED TRANSFER FUNCTION (HRTF) INTERPOLATION TOOL

(71) Applicant: EmbodyVR, Inc., San Mateo, CA (US)

(72) Inventors: Yuxiang Wang, Rochester, NY (US); Kaushik Sunder, Mountain View, CA (US)

(73) Assignee: EmbodyVR, Inc., San Mateo, CA (US)

( * ) Notice: Subject to any disclaimer, the term of this patent is extended or adjusted under 35 U.S.C. 154(b) by 0 days.

(21) Appl. No.: 16/215,747

(22) Filed: Dec. 11, 2018

Related U.S. Application Data

(60) Provisional application No. 62/720,790, filed on Aug. 21, 2018.

(51) Int. Cl.
*H04R 5/02* (2006.01)
*H04S 7/00* (2006.01)
*H04S 3/00* (2006.01)

(52) U.S. Cl.
CPC ..... *H04S 7/303* (2013.01); *H04S 3/008* (2013.01); *H04S 2400/01* (2013.01); *H04S 2400/13* (2013.01); *H04S 2420/01* (2013.01)

(58) Field of Classification Search
CPC .. H04S 3/008; H04S 2400/01; H04S 2400/13; H04S 2420/01; H04S 7/303
USPC ..... 381/303, 310
See application file for complete search history.

(56) References Cited

U.S. PATENT DOCUMENTS

2006/0045294 A1* 3/2006 Smyth ..... H04S 7/304 381/309
2015/0373477 A1* 12/2015 Norris ..... H04M 3/568 381/303
2016/0373877 A1* 12/2016 Laitinen ..... H04S 7/304

* cited by examiner

*Primary Examiner* — Ammar T Hamid

(57) ABSTRACT

A head related transfer function (HRTF) associated with a first spatial location grid is received. The first spatial location grid defines a plurality of head related impulse responses (HRIRs) and respective indications of where a sound source is physically located. A second spatial location grid is received. Given locations in the first spatial location grid within a predetermined distance from a target location in the second spatial location grid are determined. An acute triangle is formed based on one or more of the given locations in the first spatial location grid, where the target location in the second spatial location grid is within the acute triangle. Gain weights are determined based on the one or more of the given locations and the target location. The gain weights are applied to a respective HRIR associated with the one or more of the given locations to determine an HRIR associated with the target location which is output.

19 Claims, 7 Drawing Sheets

HEAD RELATED TRANSFER FUNCTION (HRTF) INTERPOLATION TOOL

RELATED DISCLOSURE

This disclosure claims the benefit of priority under 35 U.S.C. § 119(e) of U.S. Provisional Application No. 62/720,790 filed Aug. 21, 2018 entitled "HRTF Interpolation Tool: Arbitrary Input Grid to Arbitrary Target Grid" the contents of which are herein incorporated by reference in its entirety.

FIELD OF DISCLOSURE

The disclosure is related to consumer goods and, more particularly, to mapping a head related transfer function (HRTF) associated with a first spatial location grid into a second spatial location grid by an interpolation process.

BACKGROUND

A human auditory system includes an outer ear, middle ear, and inner ear. With the outer ear, middle ear, and inner ear, the human auditory system is able to hear sound. The sound may come from various sound sources such as an audio speaker, people talking around the user, or vehicles passing by the user. A pinna of the outer ear receives the sound, directs the sound to an ear canal of the outer ear, which in turn directs the sound to the middle ear. The middle ear of the human auditory system transfers the sound into fluids of an inner ear for conversion into nerve impulses. A brain then interprets the nerve impulses to hear the sound. Further, the human auditory system is able to spatially localize the sound source. The perception is based on interactions with human anatomy. The interaction includes the sound reflecting, reverberating and/or diffracting off a head, shoulder and pinna. The interaction generates audio cues which are decoded by the brain to spatially localize the sound source.

It is now becoming more common to listen to sounds wearing personalized audio delivery devices such as headphones, headsets, hearables, earbuds, speakers, or hearing aids. The personalized audio delivery devices outputs sound, e.g., music, into the ear canal of the human auditory system. For example, a user wears an earcup seated on the pinna which outputs the sound into the ear canal of the human auditory system. Alternatively, a bone conduction headset vibrates middle ear bones to conduct the sound to the human auditory system. The user listens to the sound output by the personalized audio delivery device at the expense of usually not being able to spatially localize sound sources around the user. The sound does not interact with the human anatomy (e.g., pinna) when the user is wearing the personalized audio delivery device, audio cues are not generated, and as a result the person is not able to spatially localize the sound source.

A head related transfer function (HRTF) describes how a human head and ear shape modifies sound from a sound source at a given spatial location. The HRTF is typically determined by placing a microphone in an ear of a person and measuring how the sound from the sound source at the given spatial location is received at the microphone. In this regard, the HRTF indicates how the human head and/or ear modifies the sound. The HRTF is used to artificially generate the audio cues needed for the person to spatially localize the sound source even when the person is wearing a personalized audio delivery device.

BRIEF DESCRIPTION OF THE DRAWINGS

Features, aspects, and advantages of the presently disclosed technology may be better understood with regard to the following description, appended claims, and accompanying drawings where:

Figure 1:
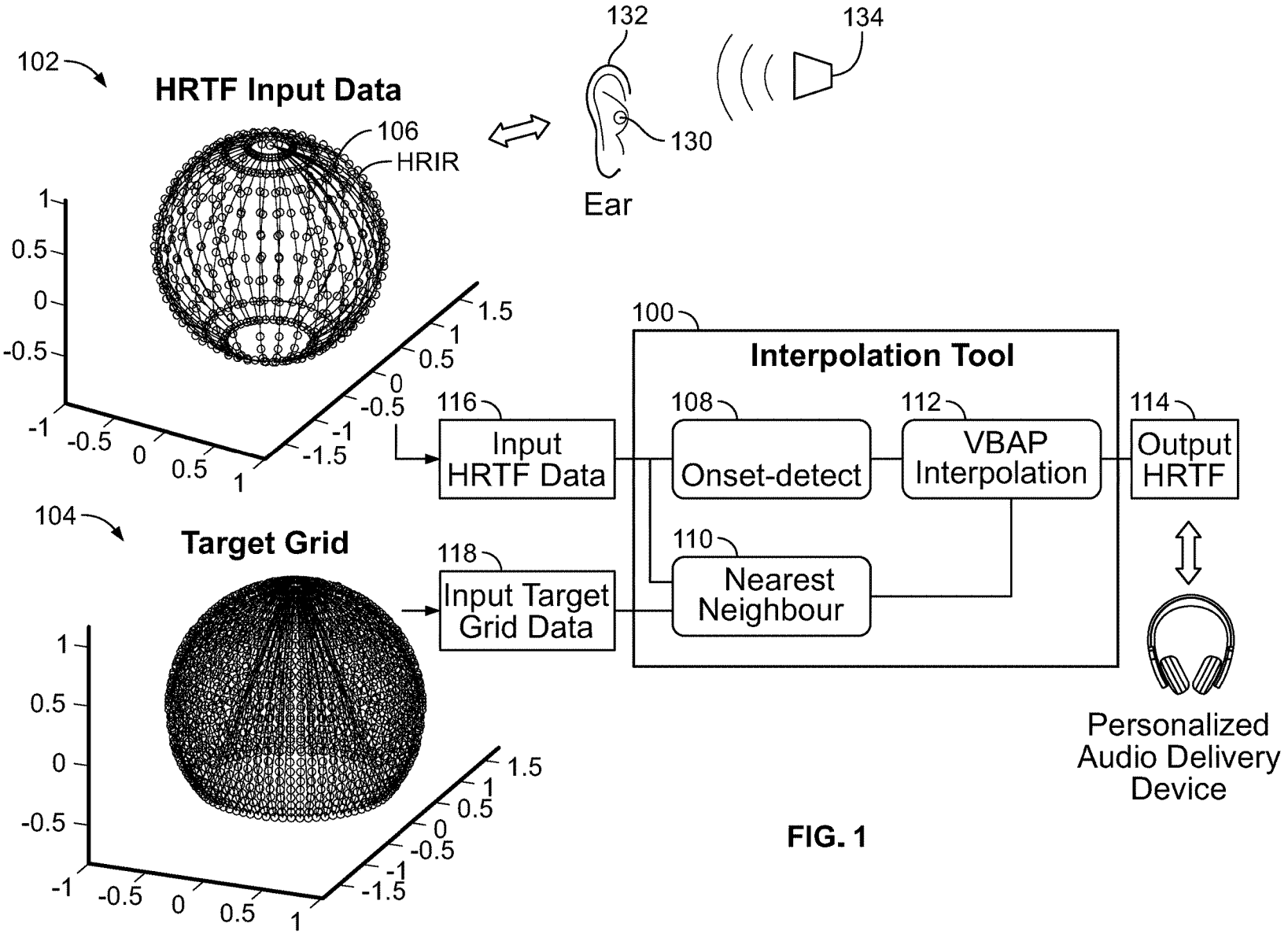
FIG. 1 is an example block diagram for an interpolation tool for mapping a head related transfer function (HRTF) associated with a first spatial location grid into a second spatial location grid by an interpolation process.

The drawings are for the purpose of illustrating example embodiments, but it is understood that the embodiments are not limited to the arrangements and instrumentality shown in the drawings.

DETAILED DESCRIPTION

The description that follows includes example systems, methods, techniques, and program flows that embody the disclosure. However, it is understood that this disclosure may be practiced without these specific details. For instance, this disclosure describes a process of mapping an HRTF associated with a first spatial location grid into a second spatial location grid by an interpolation process in illustrative examples. Aspects of this disclosure can be also applied to applications other than mapping HRTFs. Further, well-known instruction instances, protocols, structures and techniques have not been shown in detail in order not to obfuscate the description.

Overview

Head Related Transfer Function (HRTF) measurements underlie signal processing used in binaural auditory devices such as headphones, headsets, hearables, earbuds, speakers, or hearing aids. HRTFs define Head Related Impulse Responses (HRIRs) captured via a microphone located at a pinna of a user as a result of positioning at different spatial locations a sound source which outputs sound. Each HRIR is typically associated with a respective location on a spatial location grid indicative of a spatial location of the sound source when the HRIR was measured.

Embodiments described herein are directed to a process of mapping an HRTF associated with a first spatial location grid into a second spatial location grid by an interpolation process. The HRTF includes head related impulse responses (HRIRs) and a respective indication of a spatial location in the first spatial location grid. Each indication of the spatial location in the first spatial location grid may correspond to a location of a sound source which produced the associated HRIR. A target location in the second spatial location grid is indicative of a location of a sound source where the HRIR might be unknown. Locations in the first spatial location grid associated with a respective HRIR are determined. Those locations which are within a predetermined distance to the target location are ranked from closest to furthest to the target location. Then, three locations are determined from the ranking. The three locations include a nearest location to the target location and two other locations. The two other locations may be those locations in the ranking that are next nearest to the target location after the location nearest to the target location.

A determination is made whether the target location falls within an acute triangle defined by the three locations. The three locations associated with the acute triangle are returned if the target location falls within an acute triangle defined by the three locations. If the target location is not within an acute triangle defined by the three locations, two other locations are identified from the ranked locations and this process continues until the target location is within the acute triangle defined by the three locations. The HRIR associated with these three locations are the interpolated to determine the HRIR for the target location. The interpolation is based on a vector-based amplitude panning (VBAP) method.

The mapping process is repeated for various target locations in the second spatial location grid to generate HRIRs associated with the various locations in the second spatial location grid such that the HRTF associated with the first spatial location grid is mapped to the second spatial location grid. By the three locations input into the VBAP forming an acute triangle, gain weights associated with the VBAP are between zero and one, resulting in a more accurate interpolation compared to identifying the three locations associated with an obtuse triangle or irrespective of the shape of the triangle formed by the three locations. In turn, the personalized audio delivery device uses the HRTF mapped to the second spatial location grid to spatialize sound output by the personalized audio delivery device to a user wearing the personalized audio delivery device.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Detailed Examples

FIG. 1 is a block diagram of a head related transfer function (HRTF) interpolation tool 100 for mapping an HRTF associated with a first spatial location grid 102 into a second spatial location grid 104 by an interpolation process.

The HRTF describes how a human head and/or ear shape modifies sound from a sound source. The HRTF is typically determined by placing a detector 130 such as one or more microphones in an ear 132 of a person and detecting how the sound from a sound source 134 at a given spatial location is received at the ear. The sound source may be any source of sound such as a speaker, a car horn, a person speaking, etc. in an audible range of a human, e.g., 20 Hz to 20 kHz. A head related impulse response (HRIR) may be a response detected by the microphone as a result of sound being output from the sound source at the given spatial location and detecting how the sound is received at the ear as the sound reflects and resonates within features of the ear. The sound source may be moved to a plurality of different spatial locations and a respective HRIR determined at each spatial location. In this regard, the HRTF may be defined by the different spatial locations of the sound source and a respective HRIR determined at each spatial location.

Each spatial location and associated HRIR, an example which is referenced as 106, may be plotted in the first spatial location grid 102. The first spatial location grid 102 (and similarly second spatial location grid 104) may include discrete spatial locations indicated by cartesian and/or spherical coordinates in a 3-dimensional space and be a uniform or non-uniform, single or multidimensional grid. The HRTF interpolation tool 100 may then map the HRTF associated with the first spatial location grid 102 into the second spatial location grid 104. The HRTF interpolation tool 100 may include an onset detection block 108, nearest neighbor block 110, and VBAP interpolation block 112. Input HRTF data 116, indicative of the HRTF associated with the first spatial location grid 102, may be input into the HRTF interpolation tool 100. Input target grid data 118 indicative of the second spatial location grid 104 may be input into the HRTF interpolation tool 100. In one or more examples, the first and second spatial location grid 102/104 may have different resolutions. The onset detection block 108, nearest neighbor block 110, and VBAP interpolation block 112 facilitates mapping the HRTF associated with the first spatial location grid 102 into the second location spatial location grid 104 by an interpolation process. As a result, HRIRs associated with the second spatial location grid 104 may indicate measurement of the sound at the ear when the sound source is at spatial locations different from spatial locations in the first spatial location grid 102.

The HRTF interpolation tool 100 may output the HRTF associated with the second spatial location grid 104 as output HRTF 114. The output HRTF 114 may be used to spatialize sound output by a personalized audio delivery device 150 such as a headset, headphone, hearable, earbuds, speakers, or hearing aid to a given spatial location. The HRTF mapped to the second spatial location may be relevant when the HRTF associated with the first spatial location grid 102 does not define the HRIR for the given spatial location and the HRTF associated with the second spatial location grid 102 defines the HRIR for the given spatial location. The HRIR associated with the given spatial location in the second spatial location grid 104 may be applied (e.g., convolved/multiplied) to the sound in order to spatialize the sound output by the personalized audio delivery device 150 to the given spatial location in the second spatial location grid 104. In this regard, the HRTF interpolation tool 100 facilitates spatializing the sound to locations other than the spatial locations in the first spatial location grid 102.

Figure 2:
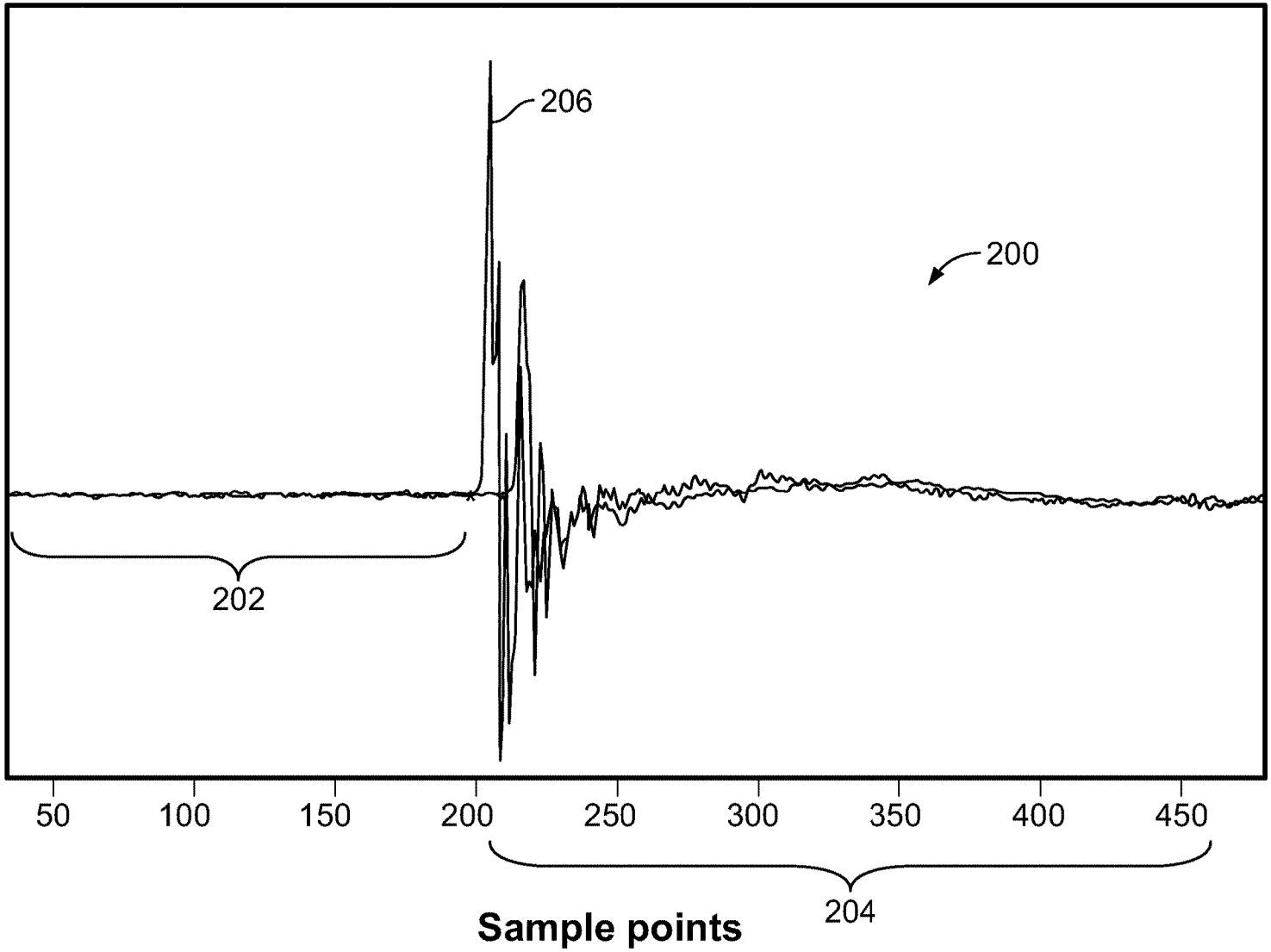
FIG. 2 illustrates an example of a head related impulse response (HRIR).

FIG. 2 illustrates an example of an HRIR 200. The HRIR 200 may be an impulse response associated with measurement of sound at the ear when the sound source is at a given spatial location. The impulse response is defined by a first part 202 and a second part 204. The first part 202 defines a response prior to an impulse 206 which is referred to as an onset time. The second part 204 defines a response at time of the impulse 206 and afterwards indicative of the sound from the sound source reaching the ear.

Figure 3:
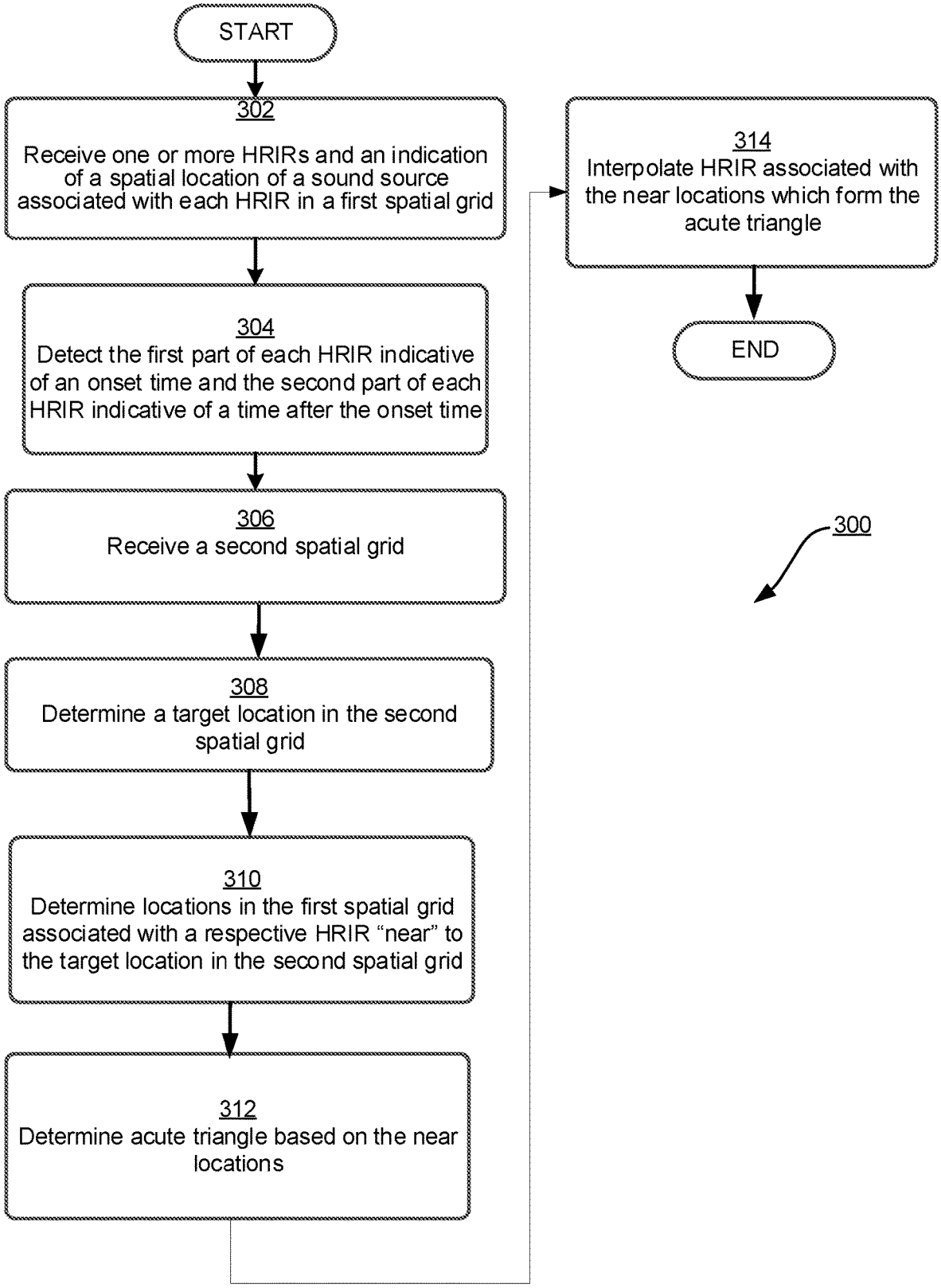
FIG. 3 is a flow chart of functionality associated with onset detection and nearest neighbor.

FIG. 3 is a flow chart 300 of functionality associated with the onset detection block and nearest neighbor block. The onset detection block may determine an onset time of an HRIR. The nearest neighbor block may determine nearest locations in the first spatial location grid to a location on the second spatial location grid that forms an acute triangle for purposes of mapping the HRIRs in the first spatial location grid to the second spatial location grid.

Methods and the other process disclosed herein may include one or more operations, functions, or actions.

Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the methods and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, each block in the FIG. 3 may represent circuitry that is wired to perform the specific logical functions in the process.

At 302, the onset detection block may receive one or more HRIRs and a respective indication of a spatial location in a first spatial location grid. Each indication of the spatial location may correspond to a location of a sound source which produced the associated HRIR. In this regard, the one or more HRIRs and the respective indication of a spatial location may define an HRTF associated with the first spatial location grid.

At 304, the onset detection block may detect the first part of each HRIR indicative of an onset time and the second part of each HRIR indicative of a time after the onset time. The onset detection block may store data indicative of the first and second part of the HRIR for subsequent processing.

At 306, a second spatial location grid may be received. The second spatial location grid may be obtained in many ways. The second spatial location grid may be provided as an input to the interpolation tool. Alternatively, the second spatial location grid may be already stored in the interpolation tool and/or generated by the interpolation tool.

At 308, the nearest neighbor block may determine a target location in the second spatial location grid. The target location may be a spatial location in the second spatial location grid indicative of where a sound source is located. The HRIR for this target location is unknown. The nearest neighbor block may determine the target location itself, the target location may be provided as user input to the nearest neighbor block, or another system in communication with the HRTF interpolation tool may identify the target location to the nearest neighbor block.

At 310, locations in the first spatial location grid associated with a respective HRIR that are within a predetermined distance to the target location in the second spatial location grid may be determined (referred to herein as "near locations").

Figure 4:
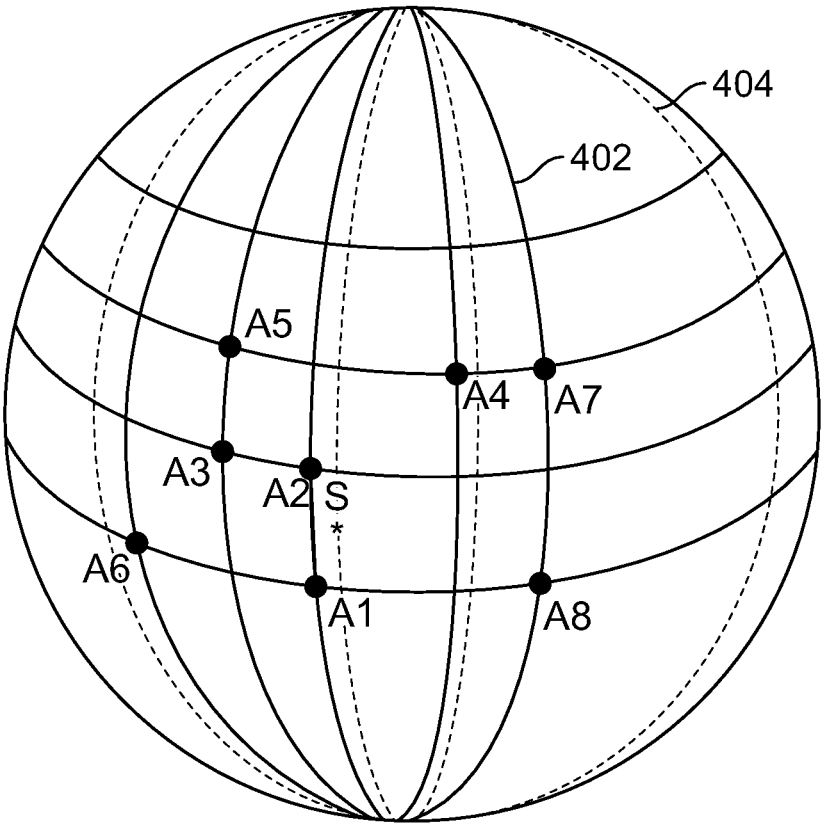
FIG. 4 illustrates example nearest locations in the first spatial location grid to a target location in the second spatial location grid.

FIG. 4 illustrates an example of the determination of these near locations. For ease of illustration, a first spatial location grid 402 (shown as solid lines) is overlaid on a second spatial location grid 404 (shown as dotted lines). Solid circles Al to A8 indicate example locations in the first spatial location grid associated with a respective HRIR near to star ("*") S which indicates an example target location in the second spatial location grid to which the HRTF is to be mapped. The nearest location to the target location may be assigned to Al and the remaining locations near to the target location may be assigned A2-A8. A2 may be closest to the target location and A8 may be furthest to the target location. Additional near locations are not shown for simplicity, but could include more than the 8 near locations which are shown. Further, S and A1 to A8 may be located in spatial positions other than what are shown. Fewer than 8 near locations may be determined as well.

At 312, an acute triangle is determined based on the near locations. One vertex of the acute triangle may be the nearest location to the target location. The other vertices may be selected from others of the near locations.

Figure 5:
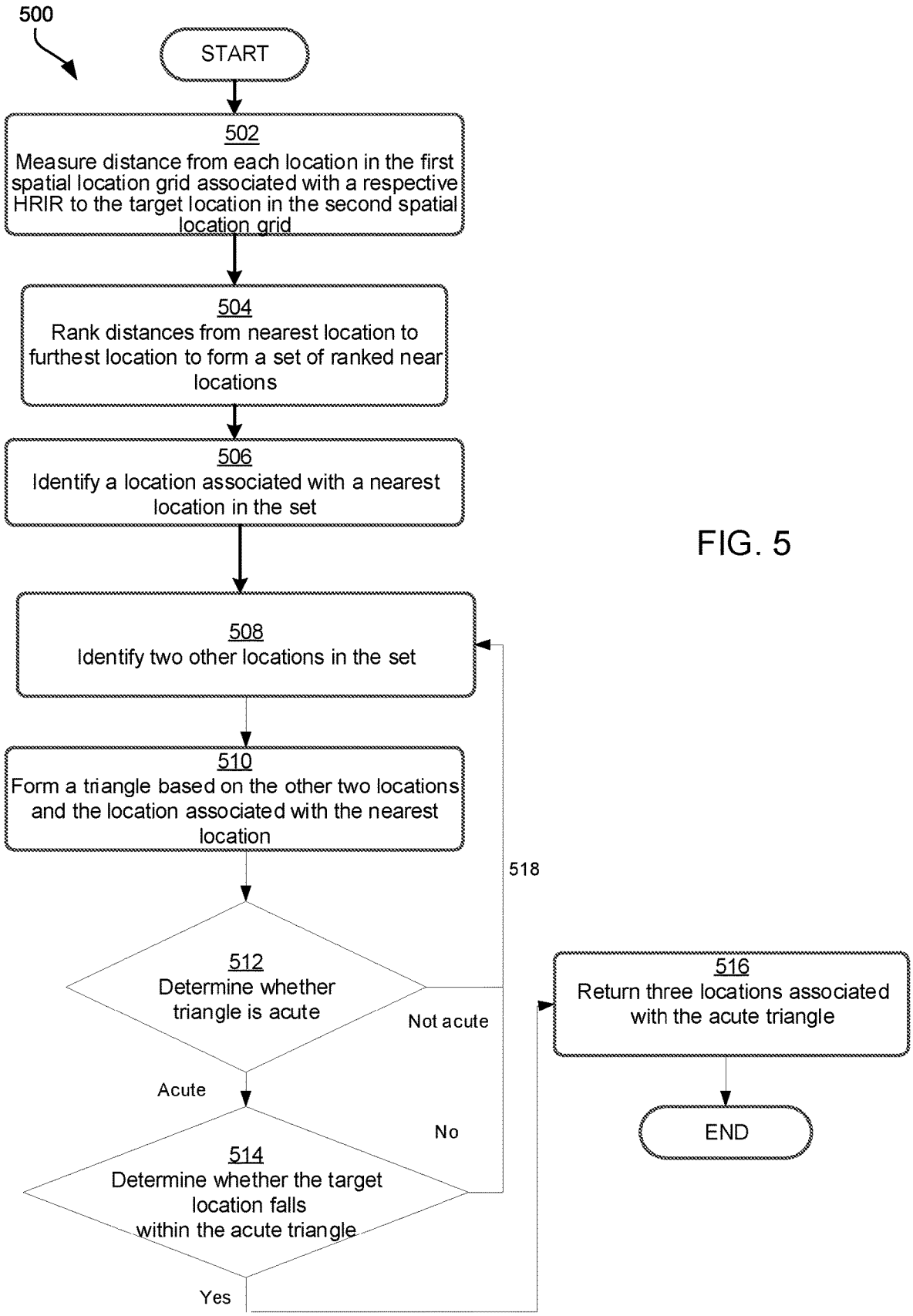
FIG. 5 is a flow chart of functionality associated with determining an acute triangle based on near locations to a target location.

FIG. 5 shows a detailed flow chart 500 of functions associated with steps 310 and/or 312. At 502, a distance is measured from each location in the first spatial location grid associated with a respective HRIR to the target location in the second spatial location grid. At 504, the distances are ranked from nearest location to furthest location to form a set of ranked near locations, e.g., an array of distances ordered from near to far or far to near. In some examples, the set may be locations in the first spatial location grid which are within a predetermined distance from the target location. A first entry in the set may correspond to location nearest to the target location while a last entry may correspond to a location furthest to the target location (or vice versa). At 506, a nearest location associated with a nearest distance to the target location in the set is identified. This may be the first entry in the set. At 508, two other locations are identified from the set. The two other locations may be those locations further than the nearest location to the target location. In some examples, at least one of the two other locations may be next nearest locations to the target location after the nearest location. The two other locations may be the second and third entries in the set. At 510, the locations at 506 and 508 (i.e., three locations) are used to form a triangle. In this regard, the locations at 506 and 508 form vertices of the triangle.

At 512, a determination is made whether the triangle is an acute triangle. If the triangle is an acute triangle, then at 514, a determination is made whether the target location is within the acute triangle defined by the three locations. At 516, the three locations are returned if the target location is within the acute triangle. At 518, processing returns to 508 if the triangle is not acute or the target location is not within the acute triangle. Then at 508, two other locations in the set are selected. The two other locations may be one or two locations in the set which have not yet been selected and/or further away from the target location compared to one or both of the locations already selected. The locations may correspond to the third and fourth entries or the fourth and fifth entries which along with the first entry define the vertices of the triangle at 510. This process may continue until block 516 is reached.

Figure 6:
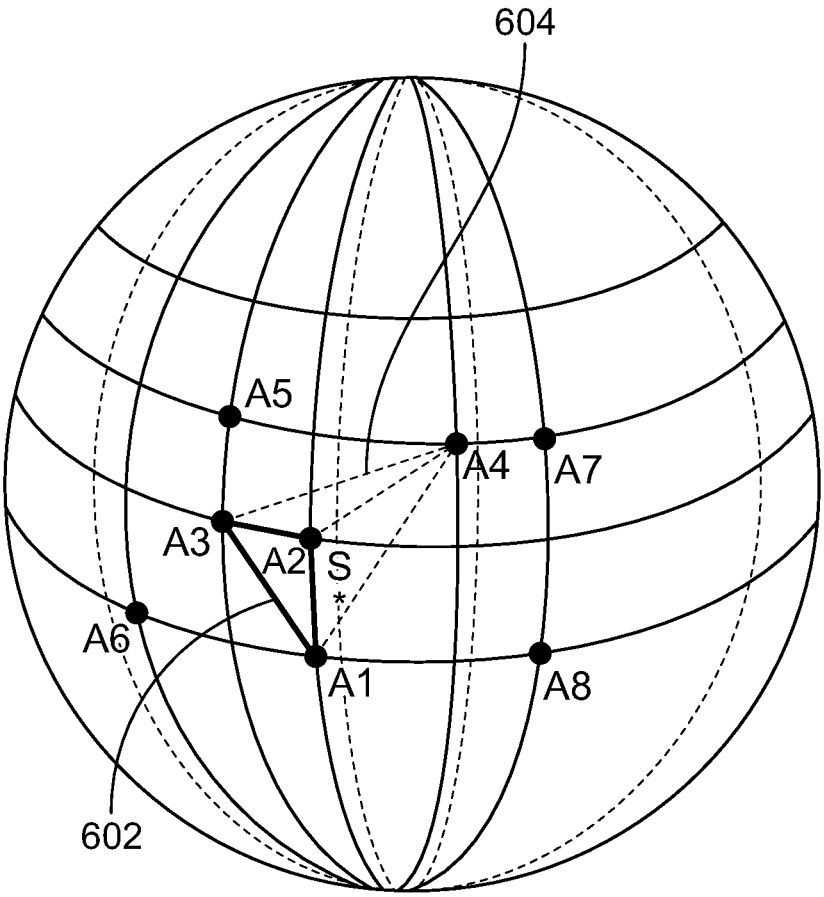
FIG. 6 illustrates an example acute triangle determined from the nearest locations in the first spatial location grid to a target location in the second spatial location grid.

FIG. 6 illustrates an example of how this acute triangle is determined. A determination is made as to whether Al, A2, A3 forms an acute triangle (e.g., triangle with all three angles less than 90 degrees). Al may be the nearest location to the target location and A2 and A3 may be the next near locations to the target location. If the triangle is acute and the target location falls within the acute triangle, the locations Al, A2, A3 associated with the triangle may be returned by the nearest neighbor block. If the triangle is obtuse or the target location does not fall within the triangle, different locations near to the target location may be selected. The different locations may be further away from the target location. In the example of FIG. 6, the triangle 602 bounded by Al, A2, A3 is obtuse so near locations other than Al and one or both of A2 and A3 may be selected. For example, near locations A3, A4 are selected to form a triangle 604 bounded by Al, A3, A4 where both triangles Al, A2, and A3 share one or more common vertices. In this example, two common vertices are shared, one of which is the nearest location to the target location. Since the triangle is acute and the target location falls within the acute triangle, the three near locations Al, A3, A4 are returned. If not, processing would continue to select other near locations (i.e., locations still further away from the target location), until the target location falls within an acute triangle.

Referring back to FIG. 3, the HRIR associated with these three input locations are interpolated to determine the HRIR for the target location at 314. The VBAP interpolation block receives the three locations associated with the acute triangle from the nearest neighbor block.

The interpolation may be based on a vector based amplitude panning (VBAP) method. The VBAP method is generally used for positioning a virtual source based on multiple loudspeakers. The VBAP method as applied to the spatial locations in the three dimensional space requires 3 input points to generate an output. The 3 input points may be the three locations associated with the acute triangle. The output may be gain weights. In one or more examples, the gain weights may be applied to the stored data associated with the first part of the HRIRs determined by the onset block for each of the three locations to produce the first part of the target HRIR. In one or more examples, the gain weights may be applied to the stored data associated with the second part of the HRIRs for each of the three locations to produce the second part of the target HRIR. In one or more examples, the first and second part of the target HRIR may be combined to produce an HRIR for the target location. In one or more other examples, one of the first and second part of the target HRIR may only be used to produce an HRIR for the target location.

The equation to determine the gain weights and target HRIR based on the VBAP is as follows. Defining P as the target location in three dimensions and L as the three locations associated with the acute triangle output by the nearest neighbor block, the gain is computed as:

$$g = p^T L_{123}^{-1} = [p_1 \;\; p_2 \;\; p_3] \begin{bmatrix} l_{11} & l_{12} & l_{13} \\ l_{21} & l_{22} & l_{23} \\ l_{31} & l_{32} & l_{33} \end{bmatrix}^{-1}$$

The target HRIR is then calculated as:

$$HRIR_{target} = [g_1 \;\; g_2 \;\; g_3] \cdot \begin{bmatrix} HRIR_1 \\ HRIR_2 \\ HRIR_3 \end{bmatrix}$$

where gain weights g=[g1 g2 g3] is a 1*3 vector, and the HRIRs with length =N associated with the three locations which form the acute triangle are formed into a 3*N matrix [HRIR1; HRIR2; HRIR3].

Steps 308-314 can be repeated for various target locations in the second spatial location grid to generate HRIRs associated with the target locations in the second spatial location grid such the HRIRs associated with the first spatial location grid are mapped to the second spatial location grid. By the 3 input locations forming an acute triangle into the VBAP, gain weights are between zero and one and/or positive, resulting in an accurate interpolation compared to identifying the 3 input locations associated with an obtuse triangle or irrespective of the shape of the triangle formed by the three locations points. The formation of an acute angle also avoids edge cases resulting from a third point to be very 'far' from the previous two (e.g., in an obtuse triangle), which also impacts accurate interpolation.

Figure 7:
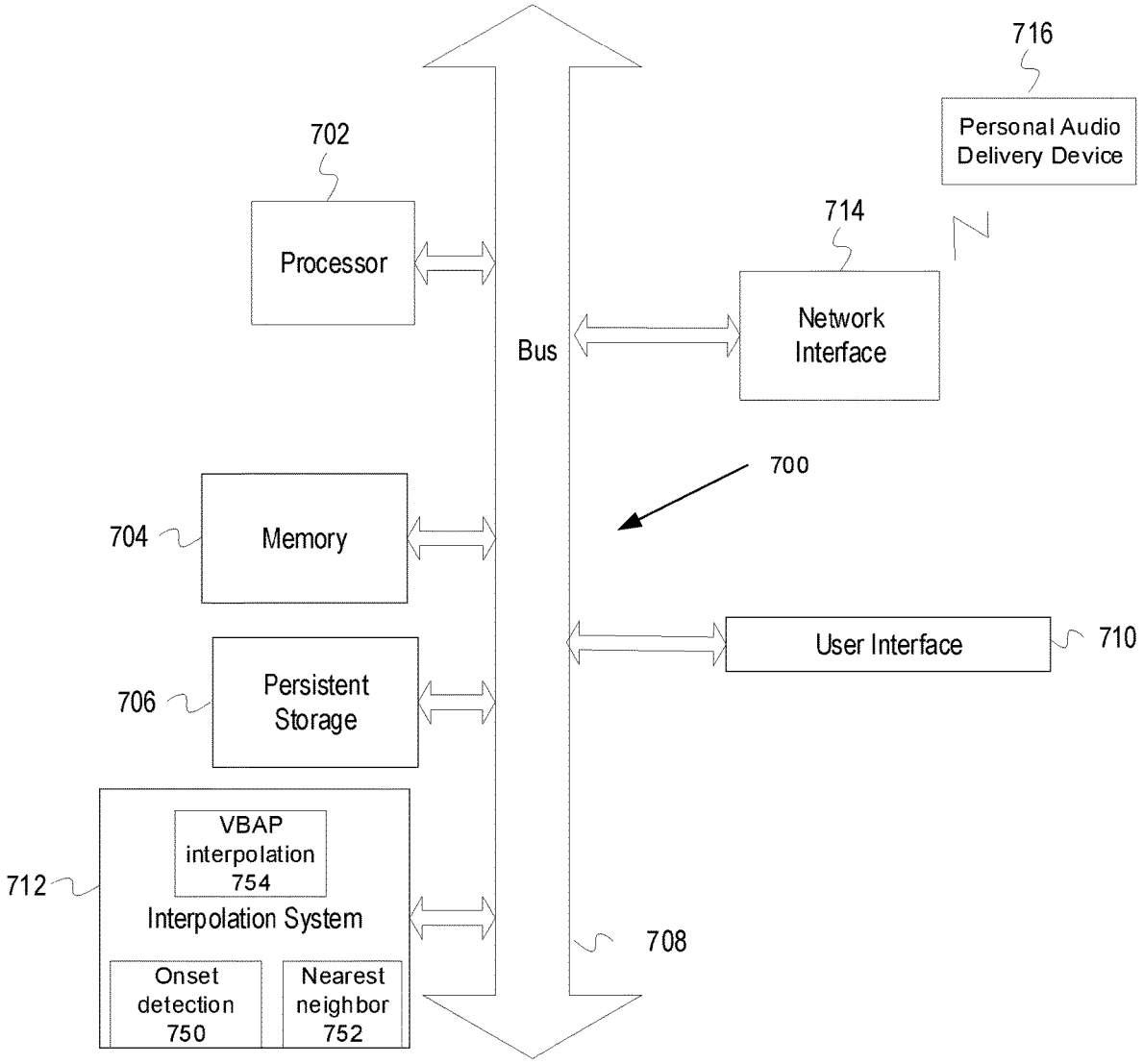
FIG. 7 is a block diagram of example apparatus for mapping an HRTF associated with a first spatial location grid into a second spatial location grid by an interpolation process.

FIG. 7 is a block diagram of a system 700 for performing the functions associated with mapping a head related transfer function (HRTF) associated with a first spatial location grid into a second spatial location grid by an interpolation process.

The apparatus 700 includes a processor 702 (possibly including multiple processors, multiple cores, multiple nodes, and/or implementing multi-threading, etc.). The apparatus 700 includes memory 704. The memory 704 may be one or more of cache, SRAM, DRAM, zero capacitor RAM, Twin Transistor RAM, eDRAM, EDO RAM, DDR RAM, EEPROM, NRAM, RRAM, SONOS, PRAM or any one or more other possible realizations of non-transitory machine-readable and/or computer-readable media for storing computer instructions, program code, and/or software executable by the processor 702.

The apparatus 700 may also include a persistent data storage 706. The persistent data storage 706 can be a hard disk drive, such as magnetic storage device for storing one or more of the HRTF associated with the first spatial location grid, the HRTF mapped to the second spatial location grid, HRIRs etc. The computer device also includes a bus 708 (e.g., PCI, ISA, PCI-Express, HyperTransport® bus, InfiniBand® bus, NuBus, etc.).

An interpolation system 712 such as the HRTF interpolation tool may facilitate mapping an HRTF associated with a first spatial location grid into a second spatial location grid by an interpolation process, as described above. The interpolation system 712 may include onset detection 750, nearest neighbor 752, and VBAP interpolation 754 to perform the mapping. In some cases, the apparatus 700 may further comprise a user interface 710. The user input 710 may comprise a computer screen or other visual device and user input such as keyboard, mouse, etc. for inputting one or more of the HRTF, first spatial location grid associated with the HRTF, and second spatial location grid which is displayed on the display in visual form. Additionally, the user interface may allow for display of an HRIR determined based on the described interpolation on the computer screen.

The apparatus 700 may have a network interface 714. The network interface 714, via a wired or wireless connection, may receive an HRTF and/or HRIRs associated with the HRTF which are to be interpolated into another spatial location grid. The HRTF may be received from the detector such as the microphone which measures an HRIR of a pinna. The network interface 714 may also provide the HRTF mapped to the second spatial location grid to a personalized audio delivery device such as headphones, headsets, hearables, earbuds, speakers, or hearing aids, etc. In turn, the personalized audio delivery device may apply an HRIR associated with the HRTF mapped to the second spatial location grid to output sound by the personalized audio delivery device to spatialize the sound to a user wearing the personalized audio delivery device at a given spatial location. The HRTF mapped to the second spatial location may be relevant when the HRTF associated with the first spatial location grid does not define the HRIR for the given spatial location and the HRTF associated with the second spatial location grid defines the HRIR for the given spatial location. In some cases, the apparatus 700 may spatialize the sound based on the mapped HRTF and the network interface 714 may output the spatialized sound to the personalized audio delivery device. Other variations are also possible.

The apparatus 700 may implement any one of the previously described functionalities partially (or entirely) in hardware and/or software (e.g., computer code, program instructions, program code) stored on a machine readable medium/media. In some instances, the software is executed by the processor 702. Further, realizations can include fewer or additional components not illustrated in FIG. 7 (e.g., video cards, audio cards, additional network interfaces, peripheral devices, etc.). The processor 702 and the memory 704 are coupled to the bus 708. Although illustrated as being coupled to the bus 708, the memory 704 can be coupled to the processor 702.

The description above discloses, among other things, various example interpolation tools, methods, systems, modules, apparatus, and articles of manufacture including, among other components, implemented in hardware, firmware, and/or software executed on hardware. It is understood that such examples are merely illustrative and should not be considered as limiting. For example, it is contemplated that any or all of the firmware, hardware, modules, and/or software aspects or components can be embodied exclusively in hardware, exclusively in software, exclusively in firmware, or in any combination of hardware, software, and/or firmware. Accordingly, the examples provided are not the only way(s) to implement such interpolation tools, methods, systems, apparatus, and/or articles of manufacture.

Additionally, references herein to "example" and/or "embodiment" means that a particular feature, structure, or characteristic described in connection with the example and/or embodiment can be included in at least one example and/or embodiment of an invention. The appearances of this phrase in various places in the specification are not necessarily all referring to the same example and/or embodiment, nor are separate or alternative examples and/or embodiments mutually exclusive of other examples and/or embodiments. As such, the example and/or embodiment described herein, explicitly and implicitly understood by one skilled in the art, can be combined with other examples and/or embodiments.

The specification is presented largely in terms of illustrative environments, interpolation tools, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

Example Embodiments

Example embodiments include the following:

Embodiment 1: A method comprising: receiving a head related transfer function (HRTF) associated with a first spatial location grid, the first spatial location grid defining a plurality of head related impulse responses (HRIRs) and respective indications of where a sound source is physically located; receiving an indication of a second spatial location grid; determining given locations in the first spatial location grid which are within a predetermined distance from a target location in the second spatial location grid; forming an acute triangle based on one or more of the given locations in the first spatial location grid, wherein the target location in the second spatial location grid is within the acute triangle; determining gain weights based on the one or more of the given locations and the target location; applying the gain weights to a respective HRIR associated with the one or more of the given locations to determine an HRIR associated with the target location; and outputting the HRIR associated with the target location.

Embodiment 2: The method of Embodiment 1, further comprising positioning the sound source at each of the given locations in the first spatial location grid and detecting, via a microphone in a pinna, a respective HRIR when the sound source outputs respective sound at each of the given locations in the first spatial location grid.

Embodiment 3: The method of Embodiment 1 or 2, wherein determining the given locations comprises: measuring a respective distance from each location in the first spatial location grid to the target location in the second spatial location grid; and ranking the respective distances from nearest to furthest distance from the target location.

Embodiment 4: The method of any one of Embodiments 1-3, wherein a vertex of the acute triangle includes a nearest location to the target location.

Embodiment 5: The method of any one of Embodiments 1-4, wherein forming the acute triangle comprises forming a given triangle based on the one or more of the given locations, determining whether the given triangle is acute, and determining whether the target location is within the given triangle which is acute.

Embodiment 6: The method of any one of Embodiments 1-5, further comprising iteratively forming a plurality of given triangles based on the one or more of the given locations until the target location is within one of the given triangles which is acute.

Embodiment 7: The method of any one of Embodiments 1-6, further comprising applying the HRIR associated with the target location to an audio signal; and outputting spatialized audio by a personalized audio delivery device based on the HRIR associated with the target location applied to the audio signal.

Embodiment 8: One or more non-transitory computer readable media comprising program code stored in memory and executable by a processor, the program code to: position a sound source at a plurality of locations indicated by a first spatial location grid and detecting, via a microphone in a pinna, respective HRIRs when the sound source outputs respective sound at each of the plurality of locations in the first spatial location grid; receive a head related transfer function (HRTF) associated with a first spatial location grid, the first spatial location grid defining a plurality of head related impulse responses (HRIRs) and respective indications of where a sound source is physically located; receive an indication of a second spatial location grid; determine given locations in the first spatial location grid which are within a predetermined distance from a target location in the second spatial location grid; form an acute triangle based on one or more of the given locations in the first spatial location grid, wherein the target location in the second spatial location grid is within the acute triangle; determine gain weights based on the one or more of the given locations and the target location; apply the gain weights to a respective HRIR associated with the one or more of the given locations to determine an HRIR associated with the target location; and output the HRIR associated with the target location.

Embodiment 9: The one or more non-transitory computer readable media of Embodiment 8, wherein the program code to determine gain weights based on the given locations comprises program code to input the given locations and the target location into a vector based amplitude panning (VBAP) equation.

Embodiment 10: The one or more non-transitory computer readable media of Embodiment 8 or 9, wherein the program code to determine the given locations comprises program code to measure a respective distance from each location in the first spatial location grid to the target location in the second spatial location grid; and rank the respective distances from nearest to furthest from the target location.

Embodiment 11: The one or more non-transitory computer readable media of any one of Embodiments 8 to 10, wherein a vertex of the acute triangle includes a closest location to the target location.

Embodiment 12: The one or more non-transitory computer readable media of any one of Embodiments 8 to 11, wherein the program code to form the acute triangle comprises program code to form a given triangle based on the one or more of the given locations, determine whether the given triangle is acute, and determine whether the target location is within the given triangle which is acute.

Embodiment 13: The one or more non-transitory computer readable media of any one of Embodiments 8 to 12, further comprising program code to iteratively form a plurality of given triangles based on the one or more of the given locations until the target location is within one of the given triangles which is acute.

Embodiment 14: The one or more non-transitory computer readable media of any one of Embodiments 8 to 13, further comprising program code to apply the HRIR associated with the target location to an audio signal; and output spatialized audio by a personalized audio delivery device based on the HRIR associated with the target location applied to the audio signal.

Embodiment 15: A system comprising: a personalized audio delivery device; a memory; a processor; an interpolation system comprising computer instructions stored in the memory and executable by the processor to perform functions to: receive a head related transfer function (HRTF) associated with a first spatial location grid, the first spatial location grid defining a plurality of head related impulse responses (HRIRs) and respective indications of where a sound source is physically located; receive an indication of a second spatial location grid; determine given locations in the first spatial location grid which are within a predetermined distance from a target location in the second spatial location grid; form an acute triangle based on one or more of the given locations in the first spatial location grid, wherein the target location in the second spatial location grid is within the acute triangle; determine gain weights based on the one or more of the given locations and the target location; apply the gain weights to a respective HRIR associated with the one or more of the given locations to determine an HRIR associated with the target location; and output, by the personalized audio delivery device, spatialized audio based on the HRIR associated with the target location.

Embodiment 16: The system of Embodiment 15, wherein a vertex of the acute triangle includes a closest location to the target location.

Embodiment 17: The system of Embodiment 15 or 16, wherein the program code to form the acute triangle comprises program code to form a given triangle based on the one or more of the given locations, determine whether the given triangle is acute, and determine whether the target location is within the given triangle which is acute.

Embodiment 18: The system of any one of Embodiments 15 to 17, further comprising program code to iteratively form a plurality of given triangles based on the one or more of the given locations until the target location is within one of the given triangles which is acute.

Embodiment 19: The system of any one of Embodiments 15 to 18, further comprising a microphone and program code to detect, via the microphone in a pinna, a respective HRIR when the sound source outputs respective sound at each of the given locations in the first spatial location grid.

Embodiment 20: The system of any one of Embodiments 15 to 19, wherein the program code to determine the given locations comprises program code to measure a respective distance from each location in the first spatial location grid to the target location in the second spatial location grid; and ranking the respective distances from nearest to furthest distance from the target location.

We claim:

1. A method comprising:

receiving a head related transfer function (HRTF) associated with a first spatial location grid, the first spatial location grid defining a plurality of head related impulse responses (HRIRs) and respective indications of where a sound source is physically located;

receiving an indication of a second spatial location grid;

determining given locations in the first spatial location grid which are within a predetermined distance from a target location in the second spatial location grid;

forming a triangle based on one or more of the given locations in the first spatial location grid;

determining that the triangle is acute;

determining that the target location is within the acute triangle;

determining gain weights based on the one or more of the given locations and the target location;

applying the gain weights to a respective HRIR associated with the one or more of the given locations to determine an HRIR associated with the target location; and outputting the HRIR associated with the target location.

2. The method of claim 1, further comprising positioning the sound source at each of the given locations in the first spatial location grid and detecting, via a microphone in a pinna, the respective HRIR when the sound source outputs respective sound at each of the given locations in the first spatial location grid.

3. The method of claim 1, wherein determining the given locations comprises measuring a respective distance from each location in the first spatial location grid to the target location in the second spatial location grid; and ranking the respective distances from nearest to furthest distance from the target location.

4. The method of claim 1, wherein a vertex of the acute triangle includes a nearest location to the target location.

5. The method of claim 1, further comprising iteratively forming a plurality of given triangles based on the given locations until the target location is within one of the given triangles which is acute.

6. The method of claim 1, further comprising applying the HRIR associated with the target location to an audio signal; and outputting spatialized audio by a personalized audio delivery device based on the HRIR associated with the target location applied to the audio signal.

7. One or more non-transitory computer readable media comprising program code stored in memory and executable by a processor, the program code to:

position a sound source at a plurality of locations indicated by a first spatial location grid and detecting, via a microphone in a pinna, respective HRIRs when the sound source outputs respective sound at each of the plurality of locations in the first spatial location grid;

receive a head related transfer function (HRTF) associated with the first spatial location grid, the first spatial location grid defining a plurality of head related impulse responses (HRIRs) and respective indications of where a sound source is physically located;

receive an indication of a second spatial location grid;

determine given locations in the first spatial location grid which are within a predetermined distance from a target location in the second spatial location grid; form a triangle based on one or more of the given locations in the first spatial location grid;

determine that the triangle is acute;

determine that the target location is within the acute triangle;

determine gain weights based on the one or more of the given locations and the target location;

apply the gain weights to a respective HRIR associated with the one or more of the given locations to determine an HRIR associated with the target location; and output the HRIR associated with the target location.

8. The one or more non-transitory computer readable media claim 7, wherein the program code to form a triangle comprises program code to form an acute triangle having vertices corresponding to one or more of the given locations in the first spatial location grid, and wherein the program code to determine gain weights comprises program code to process, using a vector based amplitude panning (VBAP) equation, the vertices of the acute triangle and the target location to generate the gain weights.

9. The one or more non-transitory computer readable media of claim 7, wherein the program code to determine the given locations comprises program code to measure a respective distance from each location in the first spatial location grid to the target location in the second spatial location grid; and rank the respective distances from nearest to furthest from the target location.

10. The one or more non-transitory computer readable media of claim 7, wherein a vertex of the acute triangle includes a closest location to the target location.

11. The one or more non-transitory computer readable media of claim 7, further comprising program code to iteratively form a plurality of given triangles based on the one or more of the given locations until the target location is within one of the given triangles which is acute.

12. The one or more non-transitory computer readable media of claim 7, further comprising program code to apply the HRIR associated with the target location to an audio signal; and output spatialized audio by a personalized audio delivery device based on the HRIR associated with the target location applied to the audio signal.

13. A system comprising:

a personalized audio delivery device;

a memory;

a processor;

an interpolation system comprising computer instructions stored in the memory and executable by the processor to perform functions to:

receive a head related transfer function (HRTF) associated with a first spatial location grid, the first spatial location grid defining a plurality of head related impulse responses (HRIRs) and respective indications of where a sound source is physically located;

receive an indication of a second spatial location grid;

determine given locations in the first spatial location grid which are within a predetermined distance from a target location in the second spatial location grid;

form a triangle based on one or more of the given locations in the first spatial location grid;

determine that the triangle is acute;

determine that the target location is within the acute triangle;

determine gain weights based on the one or more of the given locations and the target location;

apply the gain weights to a respective HRIR associated with the one or more of the given locations to determine an HRIR associated with the target location; and output, by the personalized audio delivery device, spatialized audio based on the HRIR associated with the target location.

14. The system of claim 13, wherein a vertex of the acute triangle includes a closest location to the target location.

15. The system of claim 13, further comprising program code to iteratively form a plurality of given triangles based on the one or more of the given locations until the target location is within one of the given triangles which is acute.

16. The system of claim 13, further comprising a microphone and program code to detect, via the microphone in a pinna, the respective HRIR when the sound source outputs respective sound at each of the given locations in the first spatial location grid.

17. The system of claim 13, wherein the program code to determine the given locations comprises program code to measure a respective distance from each location in the first spatial location grid to the target location in the second spatial location grid; and ranking the respective distances from nearest to furthest distance from the target location.

18. The method of claim 1, wherein said forming a triangle comprises forming an acute triangle having vertices corresponding to one or more of the given locations in the first spatial location grid, and wherein said determining the gain weights comprises processing, using a vector-based amplitude panning (VBAP) equation, the vertices of the acute triangle and the target location to generate the gain weights.

19. The system of claim 13, wherein forming a triangle comprises forming an acute triangle having vertices corresponding to one or more of the given locations in the first spatial location grid, and wherein determining the gain weights comprises processing, using a vector- based amplitude panning (VBAP) equation, the vertices of the acute triangle and the target location to generate the gain weights.

* * * * *